US010643577B2

(12) United States Patent
Nakamura et al.

(10) Patent No.: US 10,643,577 B2
(45) Date of Patent: May 5, 2020

(54) DISPLAY DEVICE

(71) Applicant: Sharp Kabushiki Kaisha, Sakai, Osaka (JP)

(72) Inventors: Jin Nakamura, Sakai (JP); Hiroyuki Higashino, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/064,539

(22) PCT Filed: Dec. 19, 2016

(86) PCT No.: PCT/JP2016/087733

§ 371 (c)(1),
(2) Date: Jun. 21, 2018

(87) PCT Pub. No.: WO2017/110721

PCT Pub. Date: Jun. 29, 2017

(65) Prior Publication Data

US 2018/0357979 A1 Dec. 13, 2018

(30) Foreign Application Priority Data

Dec. 22, 2015 (JP) ..... 2015-249335

(51) Int. Cl.
*G09G 5/10* (2006.01)
*G09G 3/20* (2006.01)
(Continued)

(52) U.S. Cl.
CPC ..... *G09G 5/10* (2013.01); *G09G 3/2003* (2013.01); *G09G 3/2074* (2013.01);
(Continued)

(58) Field of Classification Search
CPC ..... G09G 5/10; G09G 3/2003; G09G 3/2074; G09G 3/3208; G09G 3/3607;
(Continued)

(56) References Cited

U.S. PATENT DOCUMENTS 9,875,721 B2 * 1/2018 Lee ..... G09G 5/003
2008/0088568 A1 * 4/2008 Haga ..... G09G 3/18 345/100
(Continued)

FOREIGN PATENT DOCUMENTS

JP 2009-300556 A 12/2009
JP 2010-134361 A 6/2010
(Continued)

*Primary Examiner* — Sejoon Ahn
(74) *Attorney, Agent, or Firm* — Keating & Bennett, LLP

(57) ABSTRACT

A display device has a display area in a non-rectangular shape, and in the display device, a plurality of rectangular-shaped pixels are arranged in the display area and a non-display area, each pixel being composed of a plurality of subpixels that correspond to a plurality of colors, respectively. The display device includes a brightness value adjustment unit that, during image display, adjusts a brightness value of a boundary pixel that is partially included in the display area and is partially included in the non-display area, in such a manner that the brightness value of the boundary pixel is between a brightness value of a pixel whose subpixels are all included in the non-display area and a brightness value of a pixel that is adjacent to the boundary pixel and whose subpixels are all included in the display area.

2 Claims, 6 Drawing Sheets

(51) Int. Cl.
*G09G 3/3208* (2016.01)
*G09G 3/36* (2006.01)

(52) U.S. Cl.
CPC ..... *G09G 3/3208* (2013.01); *G09G 3/3607* (2013.01); *G09G 2310/0232* (2013.01); *G09G 2320/0233* (2013.01); *G09G 2320/0242* (2013.01); *G09G 2320/0646* (2013.01); *G09G 2340/0457* (2013.01); *G09G 2360/16* (2013.01)

(58) Field of Classification Search
CPC ... G09G 2310/0232; G09G 2320/0233; G09G 2320/0242; G09G 2320/0646; G09G 2340/0457; G09G 2360/16; G02F 1/133
See application file for complete search history.

(56) References Cited

U.S. PATENT DOCUMENTS

| | | | | |
|---|---|---|---|---|
| 2009/0102824 | A1 | 4/2009 | Tanaka et al. | |
| 2009/0309813 | A1* | 12/2009 | Fujita ..... | G02F 1/133512 345/55 |
| 2010/0013853 | A1 | 1/2010 | Takatori | |
| 2010/0141874 | A1 | 6/2010 | Morita | |
| 2015/0255030 | A1* | 9/2015 | Watsuda ..... | G09G 3/3648 345/92 |

FOREIGN PATENT DOCUMENTS

| | | | |
|---|---|---|---|
| JP | 2015-084104 | A | 4/2015 |
| WO | 2007/105700 | A1 | 9/2007 |

* cited by examiner

DISPLAY DEVICE

TECHNICAL FIELD

The present invention relates to a display device.

BACKGROUND ART

In recent years, a display device whose display area is in a non-rectangular shape has been developed. In a case where every pixel is in a rectangular shape, when display control is performed pixel by pixel, the display sometimes has step-like ruggedness in an outermost circumference part of the display area in some cases. On the other hand, when using a black matrix or the like for covering non-display areas is attempted so as to smoothly display the outermost circumference part of the display area, however, the following occurs: in a pixel positioned on a boundary between the display area and the non-display area, subpixels that compose one pixel are covered partially, with the covered areas being different, respectively, which causes a problem that desired colors cannot be displayed.

As a technique to cope with such a problem, Patent Document 1 discloses a technique of forming pixels in non-rectangular shapes, thereby realizing a non-rectangular display area having a smooth outer-circumference contour without impairing brightness of images, visibility, and fidelity.

PRIOR ART DOCUMENT

Patent Document

Patent Document 1: JP-A-2015-84104

SUMMARY OF THE INVENTION

Problem to be Solved by the Invention

In the case of the display device disclosed in Patent Document 1, however, it is necessary to design non-rectangular pixels anew.

It is an object of the present invention to provide a technique of suppressing the occurrence of step-like ruggedness in the display, in a display device having pixels each of which is in a rectangular shape arrayed therein and having a non-rectangular display area.

Means to Solve the Problem

A display device in one embodiment of the present invention is a display device having a display area in a non-rectangular shape, wherein a plurality of rectangular-shaped pixels are arranged in the display area and a non-display area, each pixel being composed of a plurality of subpixels that correspond to a plurality of colors, respectively. The display device includes a brightness value adjustment unit that, during image display, adjusts a brightness value of a boundary pixel that is partially included in the display area and is partially included in the non-display area, in such a manner that the brightness value of the boundary pixel is between a brightness value of a pixel whose subpixels are all included in the non-display area and a brightness value of a pixel that is adjacent to the boundary pixel and whose subpixels are all included in the display area.

Effect of the Invention

The present embodiment thus disclosed makes it possible to provide smooth display by visually blurring boundary parts between the non-display area and the display area, thereby preventing step-like ruggedness from occurring in the boundary parts in the display, even if the configuration uses rectangular-shaped pixels.

MODE FOR CARRYING OUT THE INVENTION

Figure 1:
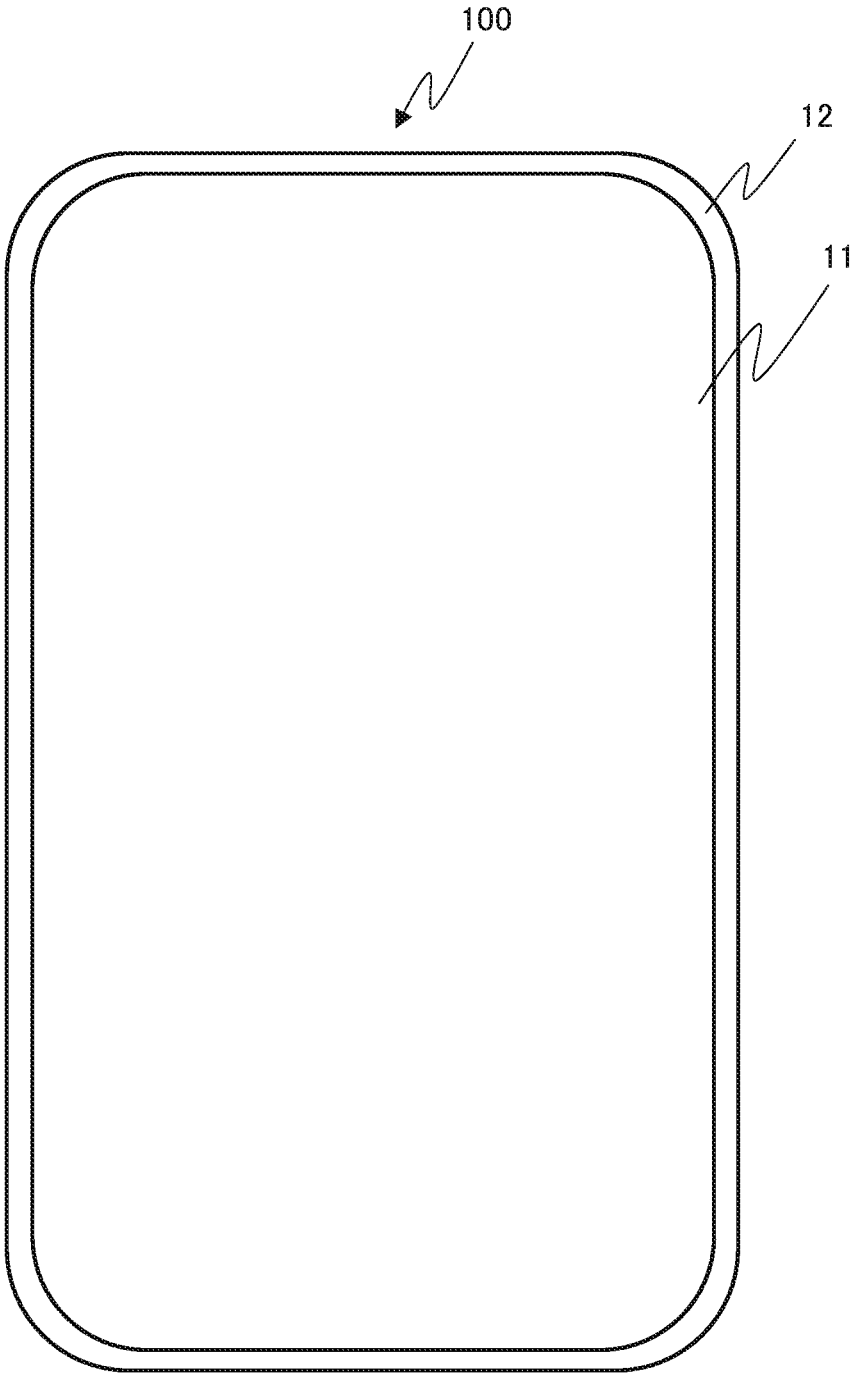
FIG. 1 illustrates an appearance and a shape of a display device in Embodiment 1.

A display device in one embodiment of the present invention is a display device having a display area in a non-rectangular shape, wherein a plurality of rectangular-shaped pixels are arranged in the display area and a non-display area, each pixel being composed of a plurality of subpixels that correspond to a plurality of colors, respectively. The display device includes a brightness value adjustment unit that, during image display, adjusts a brightness value of a boundary pixel that is partially included in the display area and is partially included in the non-display area, in such a manner that the brightness value of the boundary pixel is between a brightness value of a pixel whose subpixels are all included in the non-display area and a brightness value of a pixel that is adjacent to the boundary pixel and whose subpixels are all included in the display area (the first configuration).

With the first configuration, smooth display can be provided by visually blurring boundary parts between the display area and the non-display area that are in non-rectangular shapes, whereby step-like ruggedness can be prevented from occurring in the boundary parts in the display, even if the configuration uses rectangular-shaped pixels. Besides, the portion of the boundary pixel included in the non-display area is not covered with a light-shielding film such as a black matrix, which by no means causes such a problem that desired colors cannot be displayed.

The first configuration may be further characterized in that the brightness value adjustment unit adjusts the brightness value of the boundary pixel in such a manner that, as a portion of the boundary pixel included in the non-display area is larger in area, all of the subpixels of the boundary pixel have brightness values closer to the brightness value of the pixel in the non-display area (the second configuration).

According to the second configuration, the brightness value of a boundary pixel whose portion included in the non-display area is larger in area is adjusted in such a manner that all of the subpixels of the boundary pixel have brightness values closer to the brightness value of the pixel in the non-display area. This makes it possible to realize further smoother display in the boundary part between the display area and the non-display area.

The first or second configuration may be further characterized in that the brightness value adjustment unit adjusts the brightness value of the boundary pixel in such a manner that, as a portion of the boundary pixel included in the display area is larger in area, all of the subpixels of the boundary pixel have brightness values closer to the brightness value of the pixel in the display area (the third configuration).

According to the third configuration, the brightness value of a boundary pixel whose portion included in the display area is larger in area is adjusted in such a manner that all of the subpixels of the boundary pixel have brightness values closer to the brightness value of the pixel in the display area. This makes it possible to realize further smoother display in the boundary part between the display area and the non-display area.

Any one of the first to third configurations may be further characterized in that the brightness value adjustment unit adjusts the brightness value of the boundary pixel in such a manner that, when the brightness value of the pixel whose subpixels are all included in the non-display area and the brightness value of the pixel that is adjacent to the boundary pixel and whose subpixels are all included in the display area are equal to each other, the brightness value of the boundary pixel is equal to the brightness value of the pixel whose subpixels are all included in the non-display area (the fourth configuration).

The fourth configuration makes it possible to provide display that does not give sense of incongruity, even in a case where the brightness value of the pixel whose subpixels are all included in the non-display area and the brightness value of the pixel that is adjacent to the boundary pixel and whose subpixels are all included in the display area are equal to each other.

Embodiment

The following description describes embodiments of the present invention in detail, while referring to the drawings. Identical or equivalent parts in the drawings are denoted by the same reference numerals, and the descriptions of the same are not repeated. To make the description easy to understand, in the drawings referred to hereinafter, the configurations are simply illustrated or schematically illustrated, or the illustration of a part of constituent members is omitted. Further, the dimension ratios of the constituent members illustrated in the drawings do not necessarily indicate the real dimension ratios.

In the following description, a display device is assumed to be a liquid crystal display. The display device of the present invention, however, is not limited to a liquid crystal display, and it may be an organic EL display, a plasma display, or the like.

The display device is, for example, a smartphone. The display device, however, is not limited to a smartphone; it may be a non-rectangular display device such as a display of a tablet terminal, a television receiver, a personal computer, or the like, or alternatively, an on-vehicle display.

Embodiment 1

FIG. 1 illustrates an appearance and a shape of a display device 100 in Embodiment 1. The display device 100 in Embodiment 1 is in such a non-rectangular shape that each corner part thereof is not a right-angled corner but is a round-shaped corner having a smooth curve. Likewise, a display area 11 for displaying an image is in a non-rectangular shape that has round-shaped corner parts. An area outside the display area 11 is a non-display area 12.

Figure 2:
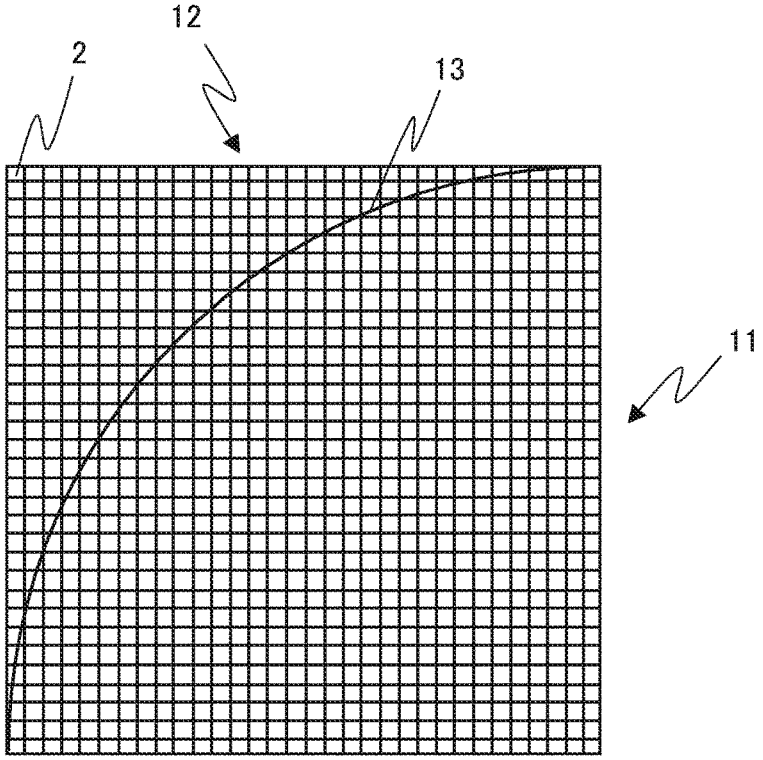
FIG. 2 is an enlarged view of a corner part in the left upper nook of the display area of the display device.

FIG. 2 is an enlarged view of a corner part in the left upper nook of the display area 11 of the display device 100. In the display device 100, a plurality of pixels 2 are arranged in matrix. Each pixel 2 is in a rectangular shape. In FIG. 2, an area on a lower side to a boundary line 13 of the display area is the display area 11, and an area on an upper side to the boundary line 13 is the non-display area 12. The rectangular-shape pixels 2 are arranged not only in the display area 11, but also in the non-display area 12.

Figure 3:
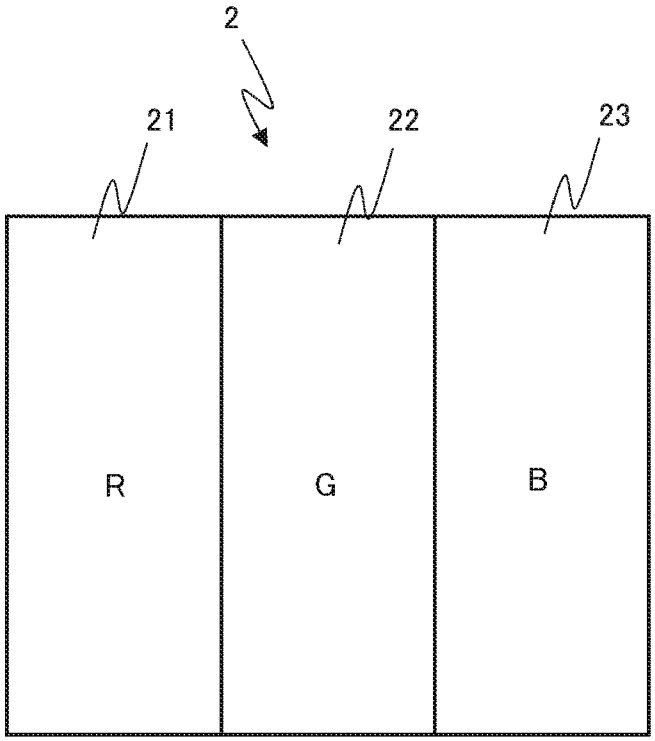
FIG. 3 illustrates a configuration of one pixel.

As illustrated in FIG. 3, one pixel 2 is composed of three subpixels 21 to 23. The subpixels 21 to 23 correspond to a plurality of colors required for performing color display, respectively. More specifically, a red color (R) filter, a green color (G) filter, and a blue color (B) filter are provided at positions of the subpixels 21 to 23, respectively.

Figure 4:
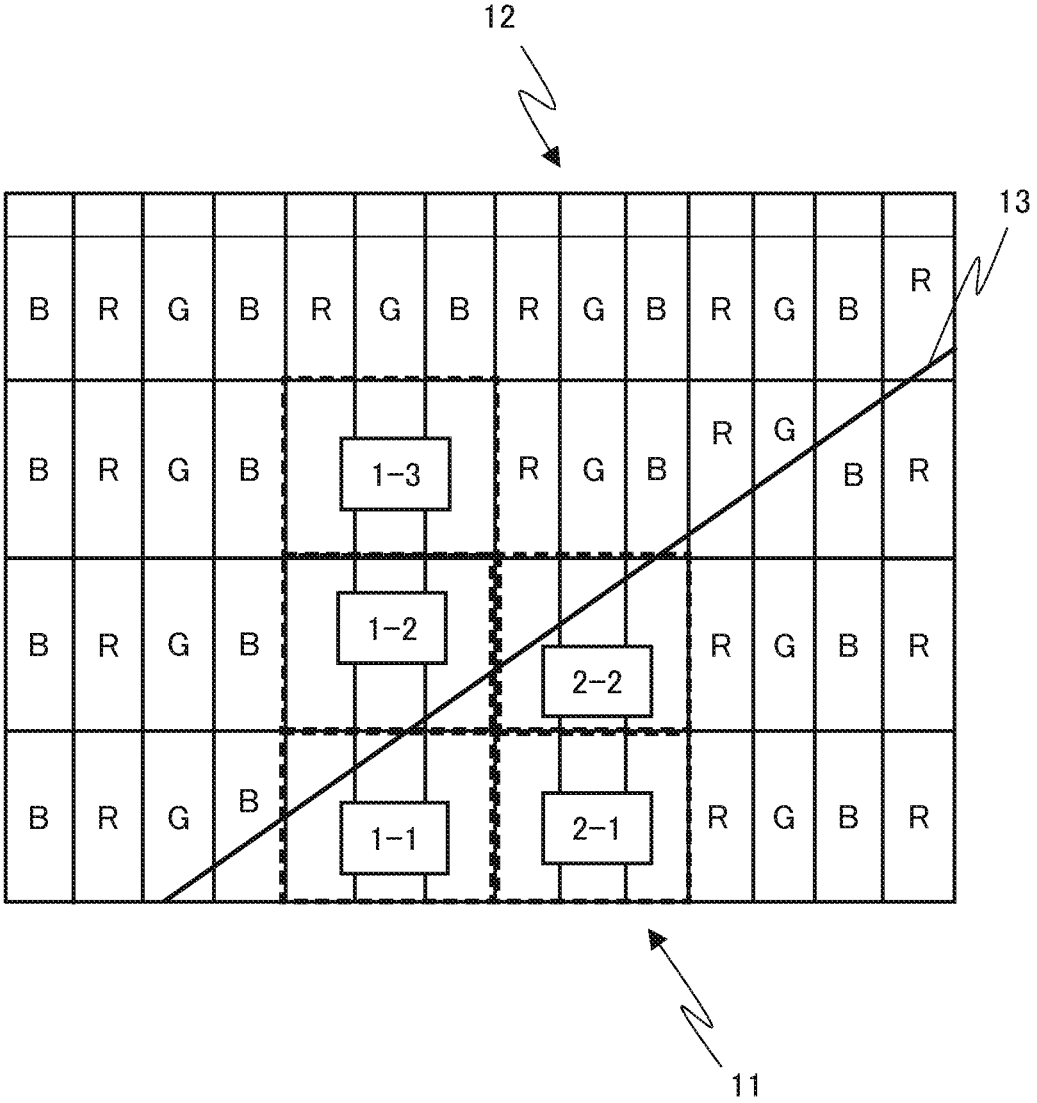
FIG. 4 is another enlarged view of the corner part in the left upper nook of the display area of the display device.

FIG. 4 is another enlarged view of the corner part in the left upper nook of the display area 11 of the display device 100. In FIG. 4, an area on a lower side to a boundary line 13 of the display area is the display area 11, and an area on an upper side to the boundary line 13 is the non-display area 12. In a case where the display area 11 is in a non-rectangular shape, the boundary line 13 of the display area goes, not between the pixels, but across the pixels, in some portions. Each pixel across which the boundary line 13 goes, therefore, has a portion included inside the display area 11 and a portion included in the non-display area 12. The pixel that is partially included in the display area 11 and partially included in the non-display area 12 in this way is referred to as a "boundary pixel" in the present description.

Here, when the display control is performed pixel by pixel for displaying an outer circumference portion of the display area 11, step-like ruggedness occurs in a specific display pattern, due to the rectangular shape of the pixels.

Further, when the non-display area is covered with a light-shielding film such as a black matrix, the boundary pixels, each of which is partially included in the display area 11 and partially included in the non-display area 12, cannot display desired colors, since the subpixels composing one pixel have different areas that are partially covered, respectively. For example, in a case where white is to be displayed, when the subpixel corresponding to the red color filter is covered, cyan color is displayed consequently, which is a color obtained by mixing green color and blue color.

In the display device 100 in the present embodiment, therefore, the boundary pixels, each of which is partially included in the display area 11 and partially included in the non-display area 12, are not covered with a light-shielding film, and the step-like ruggedness is prevented from occurring in the display by adjusting the brightness values of the boundary pixels when an image is displayed. More specifically, the brightness adjustment is performed so that the boundary pixels have brightness values between the brightness values of the pixels in the display area 11 and the brightness values of the pixels in the non-display area 12. Thereby, the contours of the display area 11 and the non-display area 12 at the boundary therebetween are visually blurred, so that the occurrence of the step-like ruggedness in the display can be suppressed. Besides, portions of the boundary pixels included in the non-display area 12 are not covered with a light-shielding film such as a black matrix, which by no means causes the above-described problem that desired colors cannot be displayed.

The brightness values are adjusted by an electric method. More specifically, the brightness value is adjusted by adjusting a voltage applied across a pixel electrode provided in each pixel, and a counter electrode opposed to the pixel electrode. This adjustment of the voltage is performed by a display driver that is not illustrated. The display driver is formed with, for example, an LSI chip that incorporates a driving circuit. In other words, the display driver functions as a brightness adjustment unit that adjusts brightness values.

The following description describes the adjustment of brightness values in detail while referring to FIG. 4. Of pixels 1-1, 1-2, 1-3, 2-1, and 2-2 illustrated in FIG. 4, the pixel 1-3 has subpixels that are all included in the non-display area 12, and the pixel 2-1 has subpixels that are all included in the display area 11. The pixels 1-1, 1-2, and 2-2 are boundary pixels.

In the present description, it is assumed that the non-display area 12 is displayed in black color. For example, a pixel whose subpixels are all included in the non-display area 12, like the pixel 1-3, is covered with a light-shielding film such as a black matrix. The configuration, however, may be such that the pixel is displayed in black color, without being covered with a light-shielding film.

In this case, the brightness value of a pixel whose subpixels are all included in the non-display area 12 is assumed to be "T1", the brightness value of a pixel whose subpixels are all included in the display area 11 is assumed to be "T2", and the brightness value of a boundary pixel is assumed to be "T3"; then, the relationship of the following expression (1) is established. It should be noted that the brightness value T2 of the pixel whose subpixels are all included in the display area 11 is indicative of a brightness value of a pixel whose subpixels are all included in the display area 11, of the pixels adjacent to the boundary pixels that are concerned herein. For example, in a case where the boundary pixel concerned is the pixel 2-2, a pixel whose subpixels are all included in the display area 11 has a brightness value T2 that is equal to the brightness value of the pixel 2-1, or a brightness value of a pixel on the right side of the boundary pixel 2-2.

$$T1<T3<T2 \quad (1)$$

The brightness value T3 of the boundary pixel is adjusted so as to be an intermediate value between the brightness value T1 of the pixel whose subpixels are all included in the non-display area 12 and the brightness value T2 of the pixel whose subpixels are all included in the display area 11. The brightness value T3 of the boundary pixel, however, is not limited to an intermediate value between the brightness value T1 of the pixel whose subpixels are all included in the non-display area 12 and the brightness value T2 of the pixel whose subpixels are all included in the display area 11. The brightness value T3 may be any value as long as it is a value between the brightness value T1 and the brightness value T2.

In a case where black color is displayed also at a pixel whose subpixels are all included in the display area 11, however, the relationship expressed by the expression (1) is not established. With such a case taken into consideration, the brightness T3 is adjusted so that at least the relationship expressed by the following expression (2) is established.

$$T1 \leq T3 \leq T2 \quad (2)$$

The brightness value of the boundary pixel is set so as to be lower as a portion thereof included in the non-display area 12 is larger in area. In the example illustrated in FIG. 4, regarding the pixels 1-1, 1-2, and 2-2, which are boundary pixels, the area included in the non-display area 12 increases in the order of the pixel 1-2, the pixel 2-2, and the pixel 1-1. In a case where white color is displayed in the pixel 2-1 whose subpixels are all included in the display area 11, the pixel 1-3 whose subpixels are all included in the non-display area 12 has the lowest brightness value, and the pixel 2-1 whose subpixels are all included in the display area 11 has the highest brightness value. When the brightness values of the pixel 1-1, the pixel 1-2, the pixel 1-3, the pixel 2-1, and the pixel 2-2 are assumed to be "T1-1", "T1-2", "T1-3", "T2-1", and "T2-2", the relationship expressed by the following expression (3) is therefore established.

$$T1\text{-}3<T1\text{-}2<12\text{-}2<T1\text{-}1<T2\text{-}1 \quad (3)$$

Figure 5A:
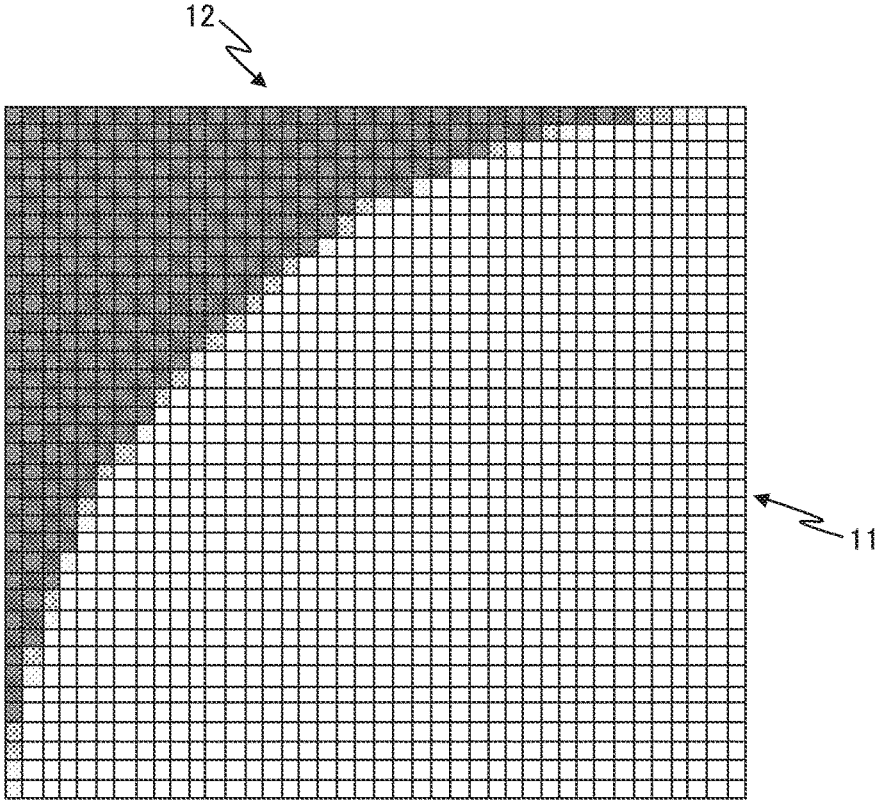
FIG. 5A illustrates an exemplary display of an outer circumference part of the display area of the display device in the present embodiment.
Figure 5B:
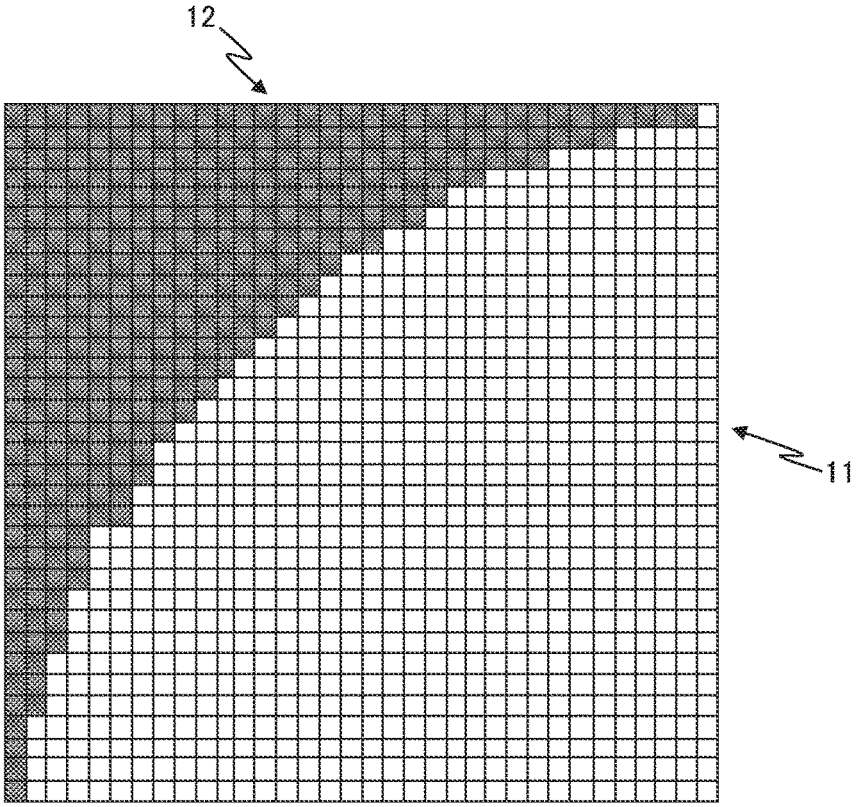
FIG. 5B illustrates an exemplary display of a comparative example in which an outer circumference part of the display area is displayed pixel by pixel.

FIG. 5A illustrates an exemplary display of an outer circumference part of the display area 11 of the display device 100 in the present embodiment. FIG. 5B illustrates an exemplary display of a comparative example in which an outer circumference part of the display area 11 is displayed pixel by pixel.

In the comparative example illustrated in FIG. 5B, display control is performed pixel by pixel, and therefore step-like ruggedness occurs in the outer circumference part of the display area 11. On the other hand, according to the display method of the display device 100 in the present embodiment, as illustrated in FIG. 5A, the brightness value of a boundary pixel that is present at a boundary between the non-display area 12 and the display area 11 is set so as to be a brightness value between the brightness value of a pixel that is included in the non-display area 12 and the brightness value of a pixel that is included in the display area 11. This makes it possible to provide smooth display by visually blurring boundary parts between the non-display area 12 and the display area 11, thereby preventing step-like ruggedness from occurring in the boundary parts. Further, regarding the boundary pixel, which is partially included in the display area 11 and partially included in the non-display area 12, the portion thereof included in the non-display area 12 is not covered with a light-shielding film such as a black matrix, the problem that a desired color cannot be displayed does not arise.

Embodiment 2

Embodiment 1 is described with the assumption that the non-display area 12 is displayed in black color. Embodiment 2 is described with reference to an exemplary case where the non-display area 12 is displayed in white color. In this case, a pixel whose subpixels are all included in the non-display area 12 may be covered with a film in white color, or alternatively, the pixel may be displayed in white color.

In a case where the non-display area 12 is in white color, the brightness value of a pixel whose subpixels are all included in the non-display area 12 is assumed to be "T1", the brightness value of a pixel whose subpixels are all included in the display area 11 is assumed to be "T2", and the brightness value of a boundary pixel is assumed to be "T3"; then, the relationship of the following expression (4) is established. It should be noted that the brightness value T2 of the pixel whose subpixels are all included in the display area 11 is indicative of a brightness value of a pixel whose subpixels are all included in the display area 11, of the pixels adjacent to the boundary pixels that are concerned herein.

$$T2<T3<T1 \quad (4)$$

The brightness value T3 of the boundary pixel is adjusted so as to be an intermediate value between the brightness value T1 of the pixel whose subpixels are all included in the non-display area 12 and the brightness value T2 of the pixel whose subpixels are all included in the display area 11. The brightness value T3 of the boundary pixel, however, is not limited to an intermediate value between the brightness value T1 of the pixel whose subpixels are all included in the non-display area 12 and the brightness value T2 of the pixel whose subpixels are all included in the display area 11. The brightness value T3 may be any value as long as it is a value between the brightness value T1 and the brightness value T2.

In a case where white color is displayed also at a pixel whose subpixels are all included in the display area 11, however, the relationship expressed by the expression (4) is not established. With such a case taken into consideration, the brightness T3 is adjusted so that at least the relationship expressed by the following expression (5) is established.

$$T2 \leq T3 \leq T1 \quad (5)$$

The brightness value of the boundary pixel is set so as to be higher as a portion of the boundary pixel included in the non-display area 12 is larger in area. In the example illustrated in FIG. 4, regarding the pixels 1-1, 1-2, and 2-2, which are boundary pixels, the area included in the non-display area 12 increases in the order of the pixel 1-2, the pixel 2-2, and the pixel 1-1. In a case where black color is displayed in the pixel 2-1 whose subpixels are all included in the display area 11, the pixel 2-1 whose subpixels are all included in the display area 11 has the lowest brightness value, and the pixel 1-3 whose subpixels are all included in the non-display area 12 has the highest brightness value. When the brightness values of the pixel 1-1, the pixel 1-2, the pixel 1-3, the pixel 2-1, and the pixel 2-2 are assumed to be "T1-1", "T1-2", "T1-3", "T2-1", and "T2-2", the relationship expressed by the following expression (6) is therefore established.

$$T2\text{-}1 < T1\text{-}1 < T2\text{-}2 < T1\text{-}2 < T1\text{-}3 \quad (6)$$

Figure 6:
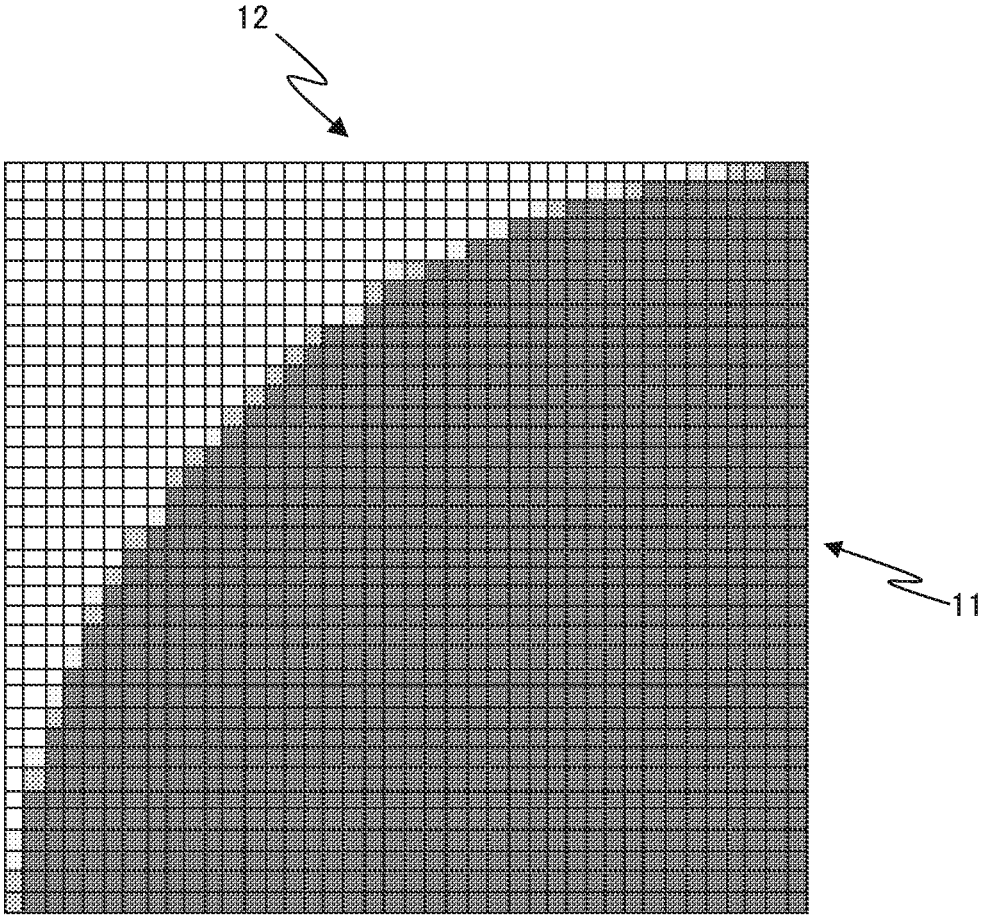
FIG. 6 illustrates an exemplary display of an outer circumference part of a display area of a display device in Embodiment 2.

FIG. 6 illustrates an exemplary display of an outer circumference part of the display area 11 of the display device 100 in the present embodiment. As illustrated in FIG. 6, the brightness value of a boundary pixel that is present at a boundary between the non-display area 12 and the display area 11 is set so as to be a brightness value between the brightness value of a pixel that is included in the non-display area 12 and the brightness value of a pixel that is included in the display area 11. This makes it possible to provide smooth display by visually blurring boundary parts between the non-display area 12 and the display area 11, thereby preventing step-like ruggedness from occurring in the boundary parts. Further, regarding the boundary pixel, which is partially included in the display area 11 and partially included in the non-display area 12, the portion thereof included in the non-display area 12 is not covered with a light-shielding film, the problem that a desired color cannot be displayed does not arise.

The above-described embodiment is merely an example for implementing the present invention. The present invention, therefore, is not limited to the above-described embodiment, and the above-described embodiment can be appropriately varied and implemented without departing from the spirit and scope of the invention.

For example, though it is assumed that one pixel is composed of three subpixels in the description, one pixel may be composed of two subpixels, or alternatively, may be composed of four or more subpixels. In a case where, for example, one pixel is composed of four subpixels, the four subpixels may correspond to four colors of red color, green color, blue color, and white color, respectively, or alternatively, may correspond to four colors of red color, green color, blue color, and yellow, respectively.

Figure 7:
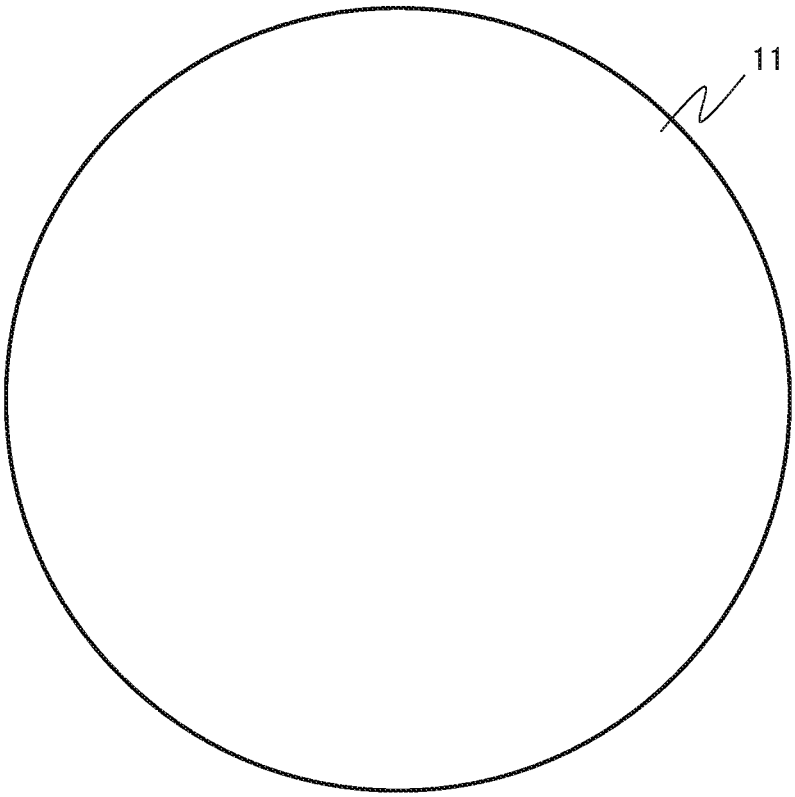
FIG. 7 illustrates a display area in a circular shape.
Figure 8:
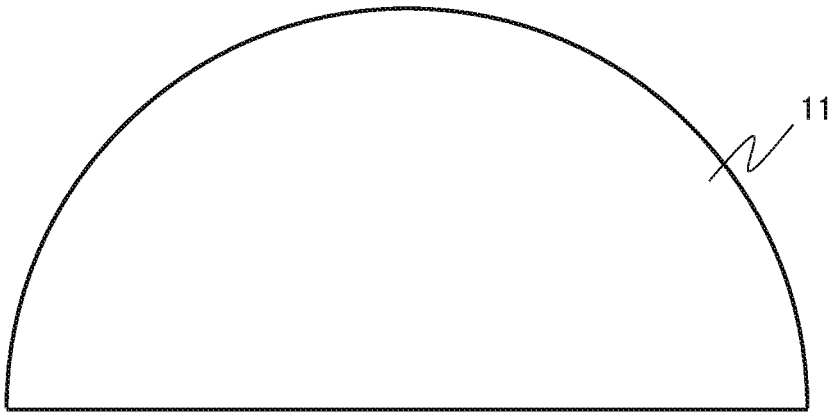
FIG. 8 illustrates a display area in a semicircular shape.

The display area 11 of the display device 100 may have any shape, as long as it is a non-rectangular shape. For example, it may be a circular shape as illustrated in FIG. 7, or may be a semicircular shape as illustrated in FIG. 8.

The non-display area 12 may have a color other than the black color in Embodiment 1 described above and the white color in Embodiment 2 described above.

In each embodiment described above, the brightness value of the boundary pixel is adjusted, but the configuration may be as follows: regarding a pixel close to the boundary between the display area 11 and the non-display area 12, even if it is a pixel whose subpixels are all included in the display area 11, the brightness value of the pixel is adjusted. Of the pixels whose subpixels are all included in the display area 11, the brightness value of a pixel close to the boundary between the display area 11 and the non-display area 12 is adjusted so as to be between the brightness value of a pixel whose subpixels are all included in the non-display area 12 and the brightness value of a pixel that is adjacent to the boundary pixel and whose subpixels are all included in the display area 11.

In the display device of Embodiments (including modification examples) described above, the display driver functioning as a brightness adjustment unit, which is assumed to be formed with an LSI as an example, is sometimes referred to as an IC, a system LSI, a super LSI, or an ultra LSI, depending on the degree of integration.

Further, the approach of circuit integration is not limited to the technique of LSI, and the circuit integration may be implemented with a dedicated circuit or a general-purpose processor. A field programmable gate array (FPGA), which can be programmed after the LSI manufacturing, a reconfigurable processor in which the connection or the setting of circuit cells inside an LSI are reconfigurable, or the like, may be used.

Still further, if a technique for circuit integration that can be replaced with LSI is invented by the progress of the semiconductor technique or another derived technique, the integration of the functional blocks can be performed by using the technique, as a matter of course. It seems possible to apply biotechnology or the like.

A part or an entirety of processing operations performed in the embodiments described above may be realized by programs. In this case, a part or an entirety of each processing operation is performed in a computer, by a central processing unit (CPU), a microprocessor, a processor, or the like. The program for performing each processing operation is stored in a storage device such as a hard disk or a ROM, and is executed on the ROM, or read out to a RAM to be executed. The storage device (storage medium) is a non-transitory tangible device, and for example, a tape, a disk, a card, a semiconductor memory, a programmable logic circuit, etc. can be used as the storage device.

Each processing operation in the embodiments described above may be realized with hardware, or may be realized with software (including cases where it is realized together with an operating systems (OS), a middleware, or a predetermined library). Further, it can be realized by using software and hardware both. It is needless to say that, in a case where the display processing of the display device according to the embodiments described above is realized with hardware, it is necessary to adjust timing for performing each processing operation. In the foregoing descriptions of the embodiments, for convenience of description, descriptions of details of the timing adjustment for various types of signals that arise in real hardware design are omitted.

DESCRIPTION OF REFERENCE NUMERALS

2: pixel
11: display area
12: non-display area
21, 22, 23: subpixel
100: display device

The invention claimed is:

1. A display device including a display area in a non-rectangular shape, wherein a plurality of rectangular-shaped pixels are arranged in the display area and a non-display area, each pixel including a plurality of subpixels that correspond to a plurality of colors, respectively, the display device comprising:

a brightness value adjustment circuit that, during image display, adjusts a brightness value of a boundary pixel that extends across both the display area and the non-display area such that the brightness value of the boundary pixel is set to a value between a first brightness value of a first pixel whose subpixels are all located in the non-display area and a second brightness value of a second pixel that is adjacent to the boundary pixel and whose subpixels are all located in the display area, wherein the brightness value adjustment circuit adjusts the brightness value of the boundary pixel m such that, as a portion of the boundary pixel included in the non-display area is larger in area, all of the subpixels of the boundary pixel have briqhtness values closer to the briqhtness value of the pixel in the non-display area, and wherein the brightness value adjustment circuit further adjusts the brightness value of the boundary pixel m such that, when the brightness value of the pixel whose subpixels are all located in the non-display area and the brightness value of the pixel that is adjacent to the boundary pixel and whose subpixels are all located in the display area are equal to each other, the brightness value of the boundary pixel is equal to the brightness value of the pixel whose subpixels are all located in the non-display area.

2. The display device according to claim 1, wherein the brightness value adjustment unit adjusts the brightness value of the boundary pixel in such a manner that, as a portion of the boundary pixel included in the display area is larger in area, all of the subpixels of the boundary pixel have brightness values closer to the brightness value of the pixel in the display area.

* * * * *